United States Patent [19]

Mowbray

[11] 4,098,249

[45] Jul. 4, 1978

[54] FUEL INJECTION PUMPING APPARATUS

[75] Inventor: Dorian Farrar Mowbray, Burnham, England

[73] Assignee: CAV Limited, Birmingham, England

[21] Appl. No.: 766,183

[22] Filed: Feb. 7, 1977

Related U.S. Application Data

[63] Continuation of Ser. No. 637,371, Dec. 3, 1975, abandoned.

[51] Int. Cl.[2] ..... F02M 59/28

[52] U.S. Cl. ..... 123/139 ST; 417/221; 417/462

[58] Field of Search ..... 123/139 AL, 139 AM, 123/139 ST, 179 L, 139 AC; 417/221, 462

[56] References Cited

U.S. PATENT DOCUMENTS

| | | | |
|---|---|---|---|
| 1,954,712 | 4/1934 | Palmer | 123/139 AC |
| 3,338,168 | 8/1967 | Davis | 417/214 X |
| 3,847,509 | 11/1974 | Bonin | 417/462 X |

*Primary Examiner*—Charles J. Myhre
*Assistant Examiner*—Tony M. Argenbright
*Attorney, Agent, or Firm*—Holman and Stern

[57] ABSTRACT

A fuel pumping apparatus includes a roller which cooperates with cam lobes formed on the internal periphery of the cam ring to effect inward movement of a pumping plunger. The maximum outward movement of the pumping plunger is determined by stop members positioned to engage with the opposite ends of the roller. One of the stop members comprises a continuous ring having a contoured in a surface but the other stop member comprises a plurality of links which are pivotally mounted and the setting of which can be varied to determine the maximum effective outward movement of the plunger and thereby the maximum amount of fuel which can be supplied.

12 Claims, 6 Drawing Figures

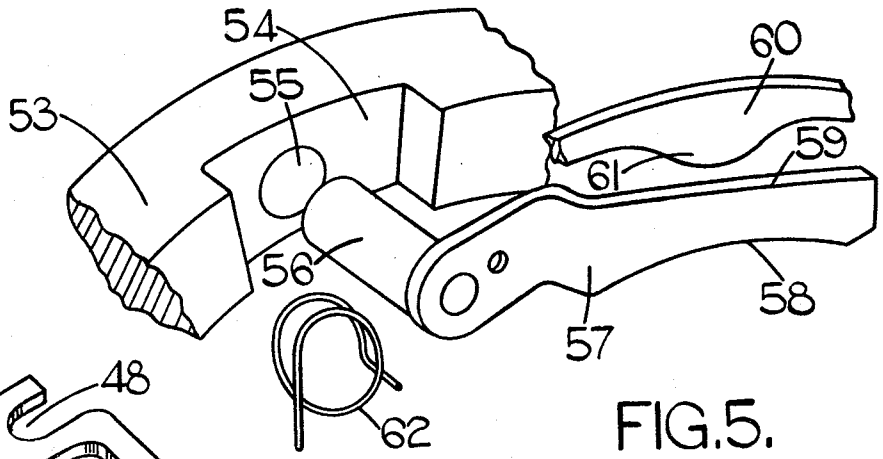
FIG.5.
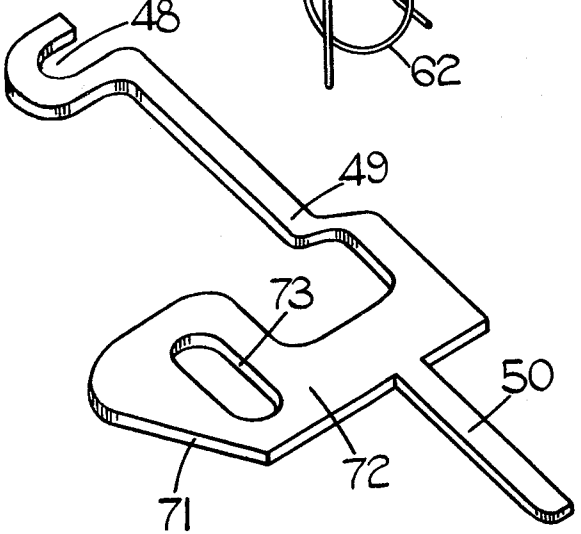
FIG.6.
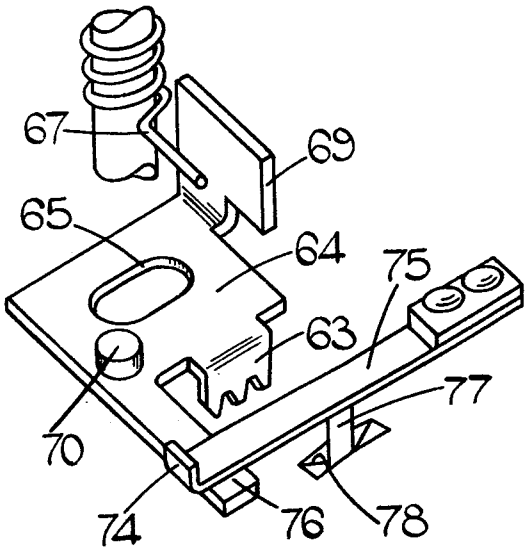

FUEL INJECTION PUMPING APPARATUS

This is a continuation of application Ser. No. 637,371, filed Dec. 3, 1975, now abandoned.

This invention relates to fuel injection pumping apparatus of the kind comprising a housing, a distributor member rotatably mounted within the housing and arranged to be driven in use, in timed relationship with an associated engine, a bore formed in the distributor member and a pump plunger mounted therein, a cam ring mounted in the housing and having cam lobes which during rotation of the distributor member effect inward movement through a roller to the plunger, a passage in the distributor member communicating with said bore, outlet ports in the housing and with which said passage registers in turn during inward movement of the plunger, and means for feeding fuel to said bore during the time when the plunger is permitted outward movement by the cam lobes.

The object of the invention is to provide such an apparatus in a simple and convenient form.

According to the invention, an apparatus of the kind specified comprises an annular and angularly adjustable stop means positioned adjacent one side of the cam ring, said stop means defining surfaces which limit the maximum outward movement of the plunger during the filling strokes thereof, and means operable from the exterior of the apparatus to allow adjustment of said stop means whereby the maximum outward movement of said plunger can be varied.

One example of a pumping apparatus in accordance with the invention will now be described with reference to the accompanying drawings, in which:

FIG. 5 is a perspective exploded view of portions of the apparatus seen clearly in FIG. 4, and FIG. 6 shows in perspective view, two portions of the apparatus which are shown in assembled relationship in FIG. 2.

Figure 1:
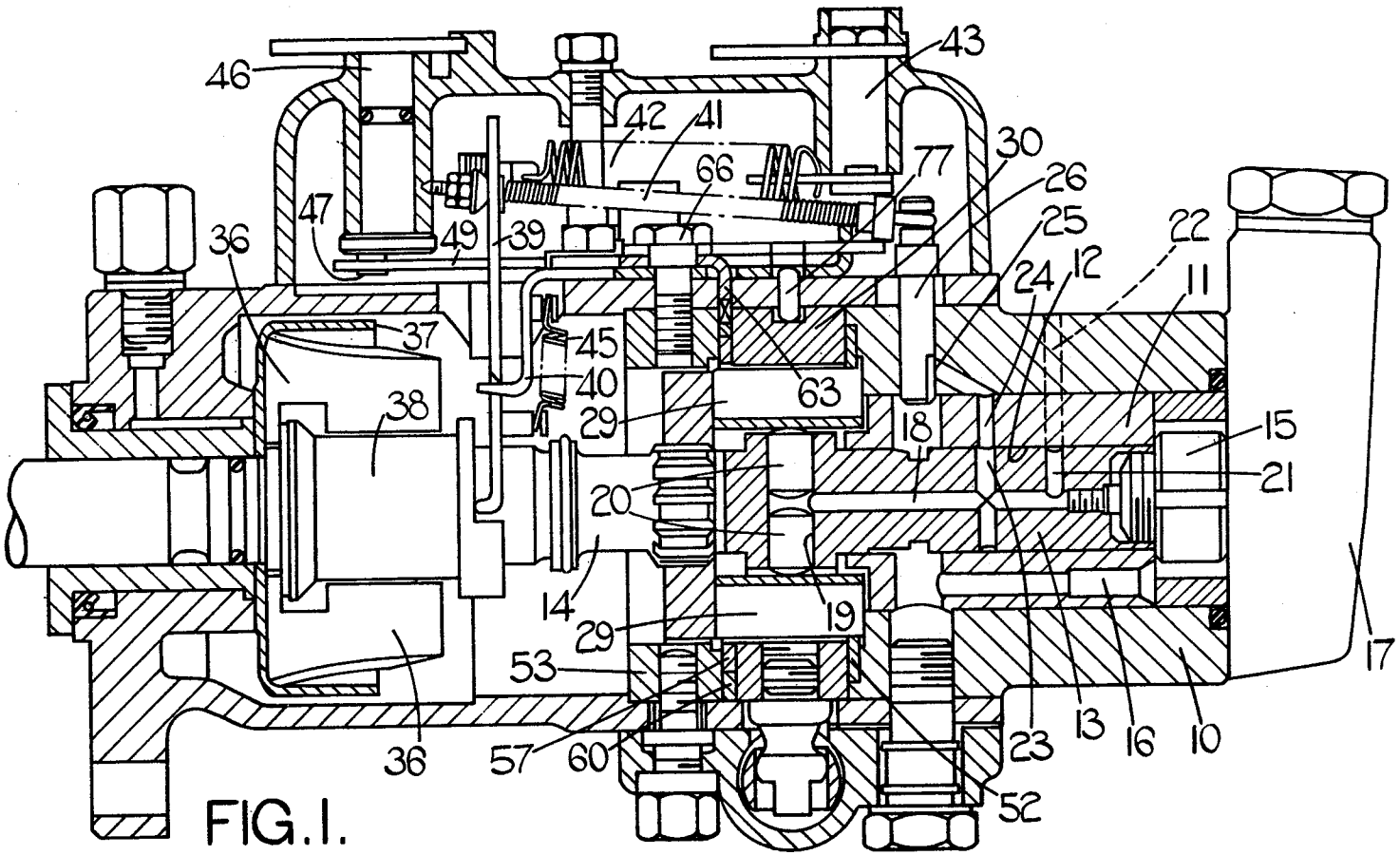
FIG. 1 is a sectional side elevation through the apparatus.
Figure 2:
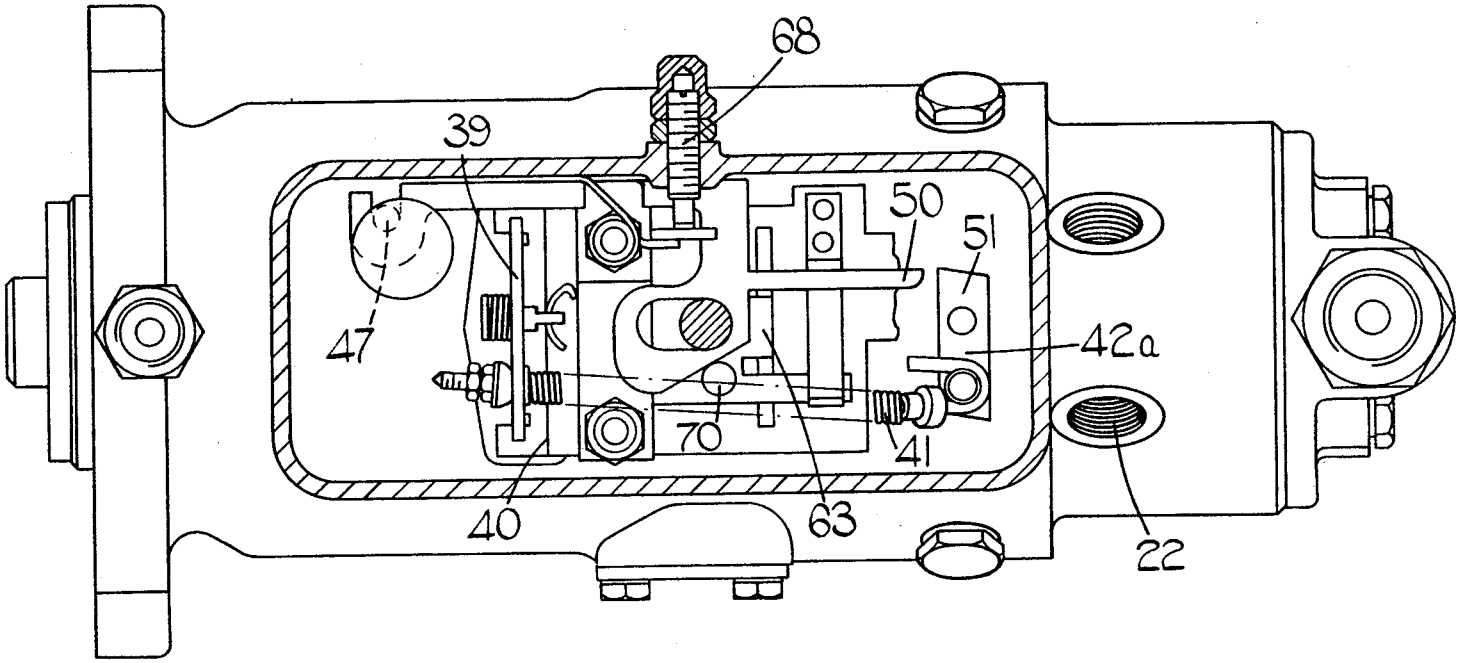
FIG. 2 is a sectional plan view of the apparatus shown in FIG. 1.

With reference to the drawings, the apparatus comprises a housing 10 in which is located a sleeve 11, the latter being provided with a bore 12 in which is mounted a rotary cylindrical distributor member 13. The distributor member is coupled at one end to a drive shaft 14 which in use, is adapted to be driven in timed relationship with the engine with which the apparatus is associated. At its other end, the distributor member mounts the rotary part 15 of a vane type feed pump which has an inlet not shown, and an outlet 16 through which fuel under pressure is supplied by the pump. The output pressure of the feed pump is controlled by a valve which is contained within a housing 17 so that the pressure varies in accordance with the speed at which the apparatus is driven.

Formed in the distributor member is a longitudinally extending passage 18 which, at one end communicates with a transversely extending bore 19 in which is mounted a pair of plungers 20. At its other end, the passage 18 registers with a delivery passage 21 which is adapted to register in turn and as the distributor member rotates, with a plurality of outlet ports 22 which are formed in the housing 10 and the sleeve 11, and which in use, communicate with the injection nozzles of the associated engine respectively. Also communicating with the passage 18 are in the particular example, four inlet passages 23 and these are arranged to register in turn with an inlet port 24 which is formed in the sleeve, and which communicates with a control port 25 opening into a cylindrical bore which contains an angularly movable throttle member 26. The throttle member has formed on its periphery a groove which is in constant communication with the outlet 16 of the feed pump.

Figure 3:
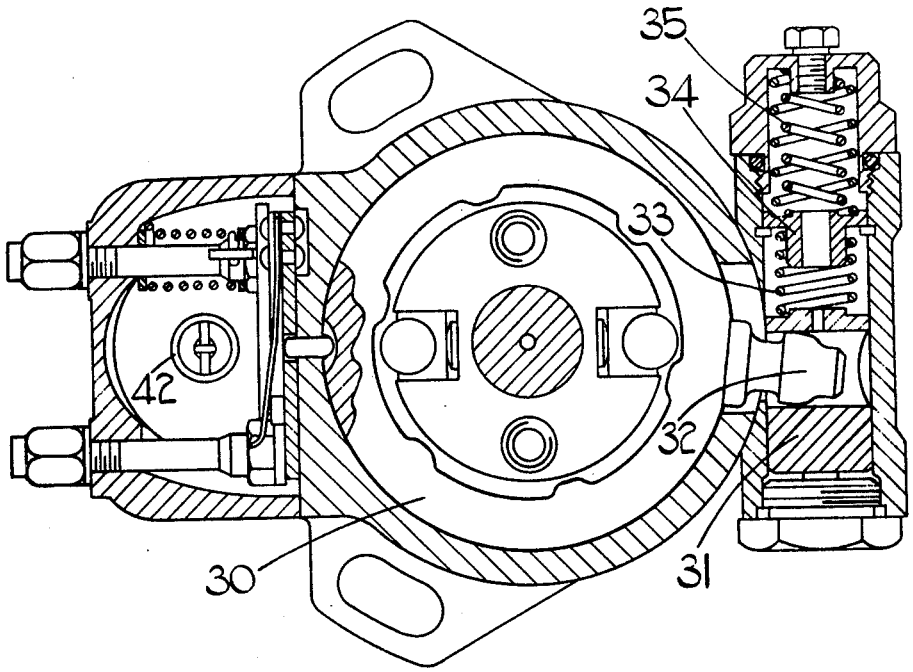
FIG. 3 is a side elevation of the apparatus shown in FIG. 1 with parts thereof shown in section.
Figure 4:
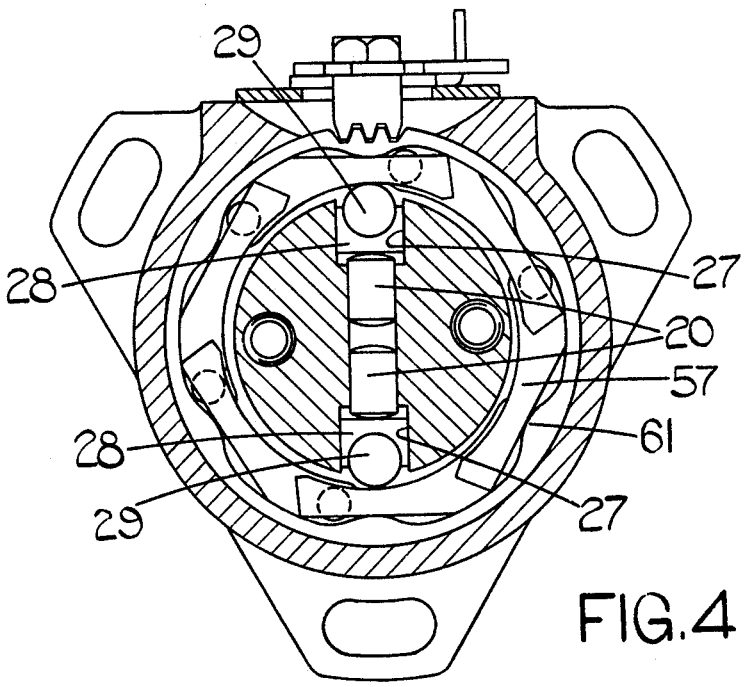
FIG. 4 is a further side elevation of the apparatus seen in FIG. 1.

As is shown in FIG. 4, the outer ends of the bore 19 terminate in slots 27 which accommodate shoes 28 respectively themselves supporting rollers 29 respectively. Moreover, mounted within the housing is an annular cam ring 30 which, as shown in FIG. 3, is provided with inwardly extending cam lobes which, as the distributor member rotates, cc-act with the rollers 29 to move the plungers 20 inwardly. Such inward movement takes place during the time when the delivery passage 21 is in register with an outlet port 22. As the plungers are moved inwardly, fuel contained within the bore 19 is discharged to an injection nozzle of the associated engine. As the distributor member continues to rotate, the passage 21 is moved out of register with a port 22 and one of the passages 23 is brought into register with the inlet port 24. When this occurs, fuel flows through the passage 18 into the bore 19 and the plungers 20 are moved outwardly. The amount of fuel which is supplied during such outward movement, which of course constitutes a filling stroke, is determined by the setting of the throttle member 26.

The cam ring 30 is movable angularly in known manner, by means of a fluid pressure operable piston 31, the piston having an aperture therein in which is engaged a peg 32 which is secured to the cam ring. The piston 31 is loaded by a first coiled compression spring 33 which is positioned between the piston and an abutment 34. The abutment 34 is also movable and is biased against a stop by a pair of coiled compression springs 35. The piston is moved against the action of the springs by means of fuel under pressure which is obtained from the outlet 16 of the feed pump and a differential valve is incorporated in the connection between the outlet 16 and the cylinder containing the piston whereby when the engine is started from rest, the pressure which is developed at the outlet 16 must attain a predetermined value before fuel under pressure can act on the piston. When the predetermined pressure has been attained however, the valve operates and even if the pressure should then fall below the predetermined pressure, the piston 31 is subjected to the outlet pressure of the feed pump.

The setting of the throttle member 26 is determined by a mechanical governor which includes a plurality of governor weights 36 which are mounted in a cage 37 carried on the drive shaft 14. A sleeve 38 is axially slidable on the drive shaft, and is moved towards the distributor member 13 as the weights 36 move outwardly with increasing speed. The movement of the sleeve is transmitted to one end of a pivotal lever 39 carried by a pivot plate 40 and the other end of the lever is connected by a flexible member 41 to an arm 42 carried by the throttle member. Outward movement of the weights effects movement of the lever 39 and the throttle member in a direction to reduce the amount of fuel which is supplied to the engine, and the movement of the lever 39 is opposed by a coiled tension spring 42, one end of which is coupled to the lever 39, and the other end of which is coupled to an angularly adjustable member 43. The member 43 is provided with an arm 44 which is coupled to the throttle control of the vehicle driven by the engine. As the force exerted by the spring 42 is increased, the lever 39 will pivot to effect an increase in the quantity of fuel supplied to the engine, and as the engine speed increases the weights 36 will oppose the additional force and will move to reduce the amount of fuel supplied to the engine. In this manner a governor action is obtained. It will be noted that a coiled tension spring 45 is interposed between the support 40 and the lever 39. The effect of this spring is to maintain the lever in engagement with the pivot 40.

Also provided is a stop control 46 which is angularly movable within the housing, and which at its lower end is provided with an eccentrically disposed pin 47, the pin 47 is engaged within a recess 48 formed in an elongated member 49 slidable within the housing and having its end 50 remote from the recess, engageable with an extension 51 of the arm **42*a* which is carried by the throttle member 26. When the stop control 46 is moved angularly, the end 50 engages with the extension 51** to move the throttle member to a position in which no fuel is supplied to the injection pump.

In FIG. 1 it will be noted that the rollers 29 and also the shoes 28 are of an axial length greater than the axial width of the cam ring 30. Moreover, positioned on one side of the cam ring in the particular example, the right hand side, is a fixed ring 52. Internal periphery of the ring 52 is positioned for engagement as will be described, with the rollers 29. Moreover, positioned on the opposite side of the cam ring, but spaced therefrom, is a fixed annular member 53. This is secured in the housing and a portion of the ring 53 is shown in greater detail in FIG. 5. At spaced angular intervals, the ring is provided in its side wall which is presented to the cam ring, with recesses 54, and in the base wall of the recess is an aperture 55 which serves as a bearing for a pin member 56. Each of the pin members 56 is attached to trailing links 57. Each link 57 is provided with a contoured inner surface 58 for engagement as will be explained, by the rollers 29, and also with an outer surface 59 which is engageable by lobes 61 formed on the internal peripheral surface of an angularly adjustable ring member 60. The ring member 60 and the trailing links 57 are disposed intermediate the annular member 53 and the cam ring 30, and this disposition is best seen in FIG. 1. Moreover, each link is biased in an outward direction, by means of a coiled torsion spring 62. The ring 60 is movable angularly, and when it is moved in the anticlockwise direction as seen in FIG. 5, inward movement will be imparted to the links 57. At one point the ring 60 is provided with teeth for engagement with complimentarily shaped teeth formed on a tongue member 63 which extends through a slot formed in the housing. The tongue member 63 is formed on a plate 64 (FIG. 6) and a latter is provided with an elongated slot 65 which extends in a direction substantially parallel to the plane of the tongue 63. The slot guides the plate for movement in conjunction with a square section portion of a retaining bolt 66 which is utilised to secure the ring 53 within the housing. The plate is biased by means of a coiled torsion spring 67 in a direction as seen in FIG. 4, towards the right. The link members 57 will therefore be moved an appropriate amount, and the extent of movement of the plate 64 towards the right under the action of the spring 67 is determined by an externally adjustable stop 68 which is engageable with an upturned portion 69 of the plate. As described, the link members 57 together with the ring 52 constitute a maximum fuel stop and as the plungers move outwardly, the rollers 29 may contact either the ring 52 or the link members 57 whereafter the rollers will tilt until contact with the other member is obtained, thereafter no further outward movement of the plungers can take place. It will be appreciated of course that it is possible for the link members to be so adjusted that contact of the rollers with the link members and ring takes place at the same time. Adjustment of the step 68 will therefore determine the maximum amount of fuel which can be supplied to the engine under normal operating conditions.

It is well known that for starting purposes, it is necessary to supply an amount of fuel in excess of the normal maximum amount of fuel which can be supplied to the engine without the emission of smoke from the exhaust of the engine. For this purpose, there is provided on the plate 64 a peg 70 positioned to co-operate with an inclined surface 71 formed on a plate portion 72 integral with the lever 49. The plate portion 72 is provided with an elongated slot 73 which engages the aforesaid portion of the bolt 66 and this serves to guide the movement of the plate like portion, and also the lever 49. As the stop member 46 is moved to reduce the amount of fuel supplied to the engine, the pins 70 will be engaged by the surface 71, and the effect of such engagement is to move the plate 64 against the action of the spring 67. Such movement of the plate will effect outward movement of the links 57 so that an increased quantity of fuel can be supplied to the engine. It should be noted, however, that during operation of the stop control to effect stopping of the engine, the throttle member will be moved to the zero fuel position by the end 50 of the lever 49, and therefore the engine will not receive excess fuel during the stopping operation.

For starting purposes, when excess fuel is required, the plate 64 is locked in the excess fuel position. For this purpose a leaf spring 75 is provided, one end of which is secured to the housing, and the other end of which is upturned. The leaf spring is biased downwardly, and in normal operation, is positioned over an extension 76 of the plate 64. The end of the leaf spring 75 is maintained free of the extension 76 during normal operation of the pump by means of a pin 77, positioned for radial movement within an aperture in the housing. The pin 77 during normal running of the engine, is engaged with the periphery of the cam ring 30. However, when the engine is stopped and the cam ring is moved to the fully retarded position by means of the springs 33 and 35, the lower end of the pin 77 enters into a recess 78 formed in the cam ring. The pin is indicated in this position in the drawings. With the pin in this position, the upper end thereof is free of the leaf spring, and if the stop control is now operated and the plate 64 moved a sufficient extent against the action of the spring 67, the extension 76 will move clear of the leaf spring, and the latter will move downwardly so that the upturned end thereof engages with the extension. The plate 64 will therefore be locked in the excess fuel position. With the plate in this position, the engine may be started and as has been mentioned, the output pressure of the feed pump must rise to a predetermined level before fluid under pressure is applied to the piston 31. Excess fuel will therefore be supplied to the engine until it has reached a predetermined speed. When the aforesaid valve is opened and the piston 31 subjected to the fuel pressure, the cam ring 30 will be moved angularly, and upward movement will be imparted to the pin 77. The effect of such movement will be to flex the leaf spring 75 so that the upturned end portion is moved clear of the extension 76. When this occurs, the spring 67 restores the plate 64 to the position as determined by the stop 68, and normal operation of the pumping apparatus will take place.

it will be noted, that if the stop control is operated whilst the engine is running, excess fuel will not be obtained, the action of the stop control being to effect movement of the throttle member towards the zero fuel position.

I claim:

1. A fuel injection pumping apparatus comprising a housing, a distributor member rotatably mounted in the housing, means coupling the distributor member to an engine so that the distributor member is driven in timed relationship with the engine, a bore formed in the distributor member and a pump plunger mounted therein, a cam ring mounted in the housing and having cam lobes, a roller which during rotation of the distributor member co-operates with the cam lobes to effect inward movement of the plunger, a passage in the distributor member communicating with said bore, outlet ports in the housing and with which said passage registers in turn during inward movement of the plunger, means for feeding fuel to said bore during the time when the plunger is permitted outward movement by the cam lobes, a fixed stop ring positioned on one side of the cam ring and engageable by one end portion of the roller as the plunger moves outwardly, an annular and angularly adjustable stop member positioned on the other side of the cam ring, a plurality of pivotal stop links positioned adjacent the other side of the cam ring, said links being positioned inwardly of said stop member, said links defining inner surfaces engageable by the other end portion of the roller and outer surfaces engageable by lobes respectively carried by said stop member, whereby the angular setting of said stop member will determine the position of said stop links and thereby the extent of outward movement of the roller, first means operable from the exterior of the housing to allow movement of said stop member to a position in which an excess of fuel will be supplied for starting purposes and second means for determining the setting of said stop member so that during normal running of the associated engine no more than a permitted maximum amount of fuel will be supplied to the engine.

2. An apparatus as claimed in claim 1 in which said stop links are pivotally mounted at one end and extend in a generally circumferential direction adjacent said cam.

3. An apparatus as claimed in claim 2 further including an annular member fixed in said housing, surfaces formed on said annular member defining recesses, and in which said stop links carry pin members respectively at said one end, said pins being located within said recesses defined in said annular member.

4. An apparatus as claimed in claim 2 including resilient means biasing said stop links into engagement with said lobes.

5. An apparatus as claimed in claim 4 including a plate slidably mounted with the housing, means coupling the plate and said stop member whereby movement of the plate along a path will impart angular movement of the stop member, resilient means biasing the plate towards one limit of its movement along said path, said second means comprising a stop screw acting to determine the movement of the plate under the action of the resilient means.

6. An apparatus as claimed in claim 5 including a peg carried by said plate and in which said first means comprises a plate portion defining a surface engageable with said peg said plate portion being movable to effect movement of said plate against the action of the resilient means biasing the plate, to a starting position in which an excess of fuel is provided for starting purposes.

7. An apparatus as claimed in claim 6 including a latch operable to retain said plate in said starting position.

8. An apparatus as claimed in claim 7 in which said cam is angularly adjustable to determine the timing of delivery of fuel by the injection pump, and fluid pressure operable means for adjusting the setting of said cam in accordance with the speed at which the apparatus is driven.

9. An apparatus as claimed in claim 8 including means operable by said cam for releasing said latch when the speed at which the apparatus is driven has risen to a predetermined value, thereby to allow said plate to move under the action of said resilient means.

10. An apparatus as claimed in claim 9 including a stop control coupled to said plate portion movement of said stop control in a direction to stop the supply of the fuel by the apparatus acting to move said plate portion to said starting position.

11. An apparatus as claimed in claim 10 including a throttle member operable to control the quantity of fuel supplied by the apparatus, said stop control when operated acting to move said throttle member to a position in which no fuel is supplied by the apparatus.

12. An apparatus as claimed in claim 11 in which said means operable by said cam comprises a pin engageable with said latch, and a recess in the cam into which said pin can enter when the apparatus is at rest, said pin being urged from said recess when the speed at which the apparatus is driven has risen to said predetermined value.

* * * * *